United States Patent [19]

Jeschke

[11] 4,242,958

[45] Jan. 6, 1981

[54] INK DUCT FOR OFFSET OR RELIEF PRINTING MACHINES

[75] Inventor: Willi Jeschke, Heidelberg, Fed. Rep. of Germany

[73] Assignee: Heidelberger Druckmaschinen AG, Heidelberg, Fed. Rep. of Germany

[21] Appl. No.: 32,412

[22] Filed: Apr. 23, 1979

Related U.S. Application Data

[63] Continuation of Ser. No. 845,370, Oct. 25, 1977, abandoned.

[30] Foreign Application Priority Data

Oct. 23, 1976 [DE] Fed. Rep. of Germany ..... 2648098

[51] Int. Cl.[3] ..... B41F 31/04; B41L 27/06; B41L 27/08

[52] U.S. Cl. ..... 101/365; 101/363

[58] Field of Search ..... 101/365, 363, 350, 157, 101/169; 118/261; 15/256.51, 256.5

[56] References Cited

U.S. PATENT DOCUMENTS

| | | | |
|---|---|---|---|
| 2,837,024 | 6/1958 | Dougan | 101/365 |
| 2,902,927 | 9/1959 | Ross | 101/365 |
| 3,318,239 | 5/1967 | Wintzer | 101/364 |

FOREIGN PATENT DOCUMENTS

| | | | |
|---|---|---|---|
| 432036 | 8/1924 | Fed. Rep. of Germany | 101/365 |
| 2413096 | 2/1975 | Fed. Rep. of Germany | 101/365 |
| 7406074 | 10/1974 | France | 101/365 |
| 120833 | 7/1976 | German Democratic Rep. | 101/365 |
| 47-3562 | 1/1972 | Japan | 101/365 |
| 954135 | 4/1964 | United Kingdom | 101/365 |

*Primary Examiner*—J. Reed Fisher

*Attorney, Agent, or Firm*—Herbert L. Lerner

[57] ABSTRACT

Ink duct for offset or relief printing machines having an ink metering device adjustable with respect to a doctor roller for varying a gap therebetween, includes an ink metering device having adjusting elements for varyingly adjusting the gap zonewise, the adjusting elements being formed with respective bracing and metering regions disposed adjacent one another in axial direction of the doctor roller, the adjusting elements at the respective bracing region thereof being continuously spring-biased into at least indirect contact with the doctor roller and, at the respective metering region thereof, being adjustable to a varying spacing thereof from the doctor roller so that the respective spacing of the respective metering region from the doctor roller determines the ink gap in a respective zone.

10 Claims, 14 Drawing Figures

INK DUCT FOR OFFSET OR RELIEF PRINTING MACHINES

This is a continuation of application Ser. No. 845,370, filed Oct. 25, 1977, now abandoned.

The invention relates to an ink duct for offset or relief printing machines and, more particularly, to such an ink duct having an ink metering device adjustable with respect to a doctor roller for varying a gap therebetween and having adjusting elements for varyingly adjusting the gap zonewise.

Heretofore known ink ducts of this general type are normally provided with a fountain screw or ink knife formed of spring steel and extending along the length of the ink duct, the ink knife being adjustable with respect to the doctor roller by means of zone screws, the spacing between the respective ink-knife zone and the doctor roller determining the thickness of the ink film. In this regard, the ink is present in the wedge-shaped space between the ink knife and the doctor roller. Due to the varying rotary movement of the doctor roller and the variable zone adjustment of the ink knife, as well as variations in consistency of the ink, varying hydrodynamic forces come into play which have an effect upon the doctor roller, the ink knife, the ink duct and, consequently, the thickness of the ink film.

Instead of the heretofore generally known zone screws, other adjusting elements (U.S. Pat. No. 3,041,968 and German Published Non-Prosecuted Application DT-OS No. 24 06 940) are also employed in ink ducts, with which zonewise regulation or control of the ink knife is likewise effected. These ink metering devices also have the disadvantage that the varying hydrodynamic forces have an immediate or direct effect in a change of the adjusted ink film thickness. A consequence thereof is that, in all heretofore known ink metering devices, the ink film formed by the gap between the ink knife and the doctor roller is not reproducible. However, the reproducibility of the ink film is an indispensable necessity, especially for modern printing-machine constructions, and more particularly if they are equipped with remote control systems for the ink zones.

The ink knives, with the many or multiple bracings thereof against the ink-zone screws, constitute a statically undetermined structure. Due to the variation in the hydrodynamic forces, the ink knive is varyingly stressed or loaded and deformed, immediately or directly causing a variation in the ink-film thickness. Likewise, the local application of a zone screw is found to have an effect upon the ink-film thickness at the adjacent zone screws, because the ink knife formed of a spring steel band varies the position thereof as a whole due to distortion. Another additional problem results from the fact that the ink duct, on the one hand, and the doctor roller, on the other hand, cannot be constructed as rigidly as is desired. If it is necessary to feed little or no ink to a given location viewed across the width of the printing machine, then, at that location, the static pressure of the ink must initially be overcome and the ink knife must then be adjustably disposed closely to the doctor roller. This brings considerable forces into play. A consequence thereof is that the doctor roller and the ink duct become bent or sag, depending upon the respective local infeed of the ink knife. This inevitably causes a great increase in the ink film thickness at the adjacent zones. Any possible reproducibility is also thereby lost.

The disadvantage of all the heretofore known construction of ink ducts of this general type is that attempts are made to adjust a gap to a few hundredths of a millimeter thickness between the parts more recently elastically formed, namely the ink doctor roller, on the one hand, and the ink knife or ink duct, on the other hand. This gap cannot be held constant under the varying operating conditions. Influences or effects, such as varying ink temperature or non-circular or eccentric revolving of the ink doctor have an additional negative effect upon the constancy of the ink gap.

It is accordingly, an object of the invention to provide an ink duct having an ink metering device adjustable with respect to the doctor roller, which ensures, in addition to a sensitive zonewise regulation or control of the ink supply, an absolute reproducibility of the respectively adjusted spacing between the ink metering device and the doctor roller, and, thereby of the thickness of the supplied ink film, independently of the respective operating conditions.

With the foregoing and other objects in view, there is provided, in accordance with the invention, an ink duct for offset or relief printing machines having an ink metering device adjustable with respect to a doctor roller for varying a gap therebetween, comprising an ink metering device having adjusting elements for varyingly adjusting the gap zonewise, the adjusting elements being formed with respective bracing and metering regions disposed adjacent one another in axial direction of the doctor roller, the adjusting elements at the respective bracing region thereof being continuously spring-biased into at least indirect contact with the doctor roller and, at the respective metering region thereof, being adjustable to a varying spacing thereof from the doctor roller so that the respective spacing of the respective metering region from the doctor roller determines the ink gap in a respective zone. Due to the resilient bracing and consequent guidance of the adjusting elements at the doctor roller, all variations and fluctuations of the ink-film thickness, as they occur in the case of the heretofore known constructions, are eliminated. The bracing regions of the adjusting elements and the guidance thereof at the doctor roller thus create the basic conditions for an adjustment of the dosing region that is reproducible at any time and, consequently, a sensitive zonewise determination of the ink gap. Consequently, varying hydrodynamic forces of the ink, bending or sagging of the doctor roller and of the ink duct, non-circular revolving of the doctor roller and other hereinaforedescribed defects of the heretofore know devices of this general type can no longer result in a variation of the ink-film thickness.

In order to eliminate any fouling or spoiling of the adjusting elements, in accordance with another feature of the invention, an elastic foil is fixed to the ink metering device and covers the adjusting elements, the respective bracing region being in indirect contact with the doctor roller through the intermediary of the elastic foil. The elastic foil is formed of plastic material, rubber, a thin steel foil or the like. It is engaged substantially tangentially with the ink doctor. It is biased or pressed constantly towards the doctor roller at the contact locations of the bracing regions. Between or adjacent the bracing regions, the elastic foil can be deformed in accordance with the adjustment of the metering regions i.e. can lift away from the doctor roller and adapt itself to the metering regions, and thereby ensures the desired passage of ink into these regions.

The foil used in the invention of the instant application is thus no longer comparable to a fountain screw or ink knife of conventional type, because, with the heretofore known fountain screws or ink knives, it was necessary to accept a compromise between the rigidity thereof and an elasticity which would permit adjustment. In the case of the foil of the invention, the rigidity can be totally dispensed with, whereas the elasticity can be optimally taken into consideration.

In accordance with another feature of the invention, the adjusting elements are of cylindrical construction and rotatable in peripheral direction thereof, and the respective bracing region is narrow with respect to the width of the respective metering region, the latter being formed by eccentric tapped grooves located adjacent the respective bracing region. The metering surfaces can, of course, also be cam-shaped or the like. The cylindrical adjusting elements are constructed with a small diameter and permit, by means of the eccentric metering surfaces, a sensitive and reproducible adjustment of the ink-film thickness, an additional advantage being attainable that the surface exerting the pressure is small and the hydrodynamic forces are consequently weak.

In accordance with a further feature of the invention, the adjusting elements are constructed of slidable flat members formed with at least one of the bracing regions, and at least one of the metering regions being formed of a wedge-shaped recess located adjacent the one bracing region. This embodiment differs only in appearance from the cylindrical adjusting elements and offers the same advantages as those offered by the latter.

In accordance with an added feature of the invention, the adjusting elements are of cylindrical construction and have a longitudinal axis with which they are pivotable with respect to the longitudinal axis of the doctor roller about a point of tangency thereof with the doctor roller through the intermediary of the elastic foil. Due to the pivoting in tangential direction, the radii of the doctor roller and of the cylindrical adjusting elements move away from one another whereby an ink gap is produced. This gap can be adjusted in the size or magnitude thereof in accordance with the pivot angle. The tangent point about which the cylindrical adjusting elements are pivoted is, in this regard, always resiliently in contact with the doctor roller through the elastic foil. This embodiment of the invention is extremely simple in the structure thereof and consequently quite economical.

The inventive concept of bracing and guiding the adjusting elements with respect to the doctor roller can also be suitably embodied without the use of a foil. Such an embodiment is provided in accordance with the invention wherein the ink metering device has a fixed support and springs means are braced on the fixed support and resiliently bias the respective bracing region of the adjusting elements into continuous direct contact with the doctor roller, the adjusting elements being constructed as slidable flat members disposed in tangential contact with the doctor roller at a bracing surface of the bracing region at one side of the flat members, the slidable flat members being formed with a wiping edge at a forward end thereof and an oblique inwardly extending recess directly behind the wiping edge and forming a metering surface of the metering region extending over the width of the respective support element except for at least one bridge which is relatively narrow compared to the width of the metering surface, the bridge being formed with the bracing surface.

This alternative embodiment of the invention likewise avoids the deficiences of the heretofore known constructions of this general type and provides a solution for the hereinaforestated problem in its entirety without having to introduce a foil. Only a slight soiling of the adjusting elements must be taken into consideration, in this regard. The structural advantage of this embodiment of the invention is that the traverse or crosspiece with the adjusting elements can be readily pivoted away from the doctor roller, for example, for cleaning purposes, without having to remove the ink from the ink duct.

In accordance with a concomitant feature of the invention, the adjusting elements are of substantially cylindrical construction and are rotatable in peripheral direction thereof, the respective bracing region being narrow with respect to the width of the respective metering region, and the respective metering region being formed by eccentric tapped grooves located adjacent the respective bracing region, the ink metering device including zonewise subdivided pressure strips, spring means supportingly biasing the pressure strips toward the doctor roller, the pressure strips being formed with a recess in a forward region thereof wherein the cylindrical adjusting elements are received, and an elastic foil fixed to the ink metering device and covering the pressure strips and the adjusting elements, the respective bracing region being biased by the spring means into indirect contact with the doctor roller through the intermediary of the elastic foil.

Other features which are considered as characteristic for the invention are set forth in the appended claims.

Although the invention is illustrated and described herein as embodied in an ink duct for offset or relief printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
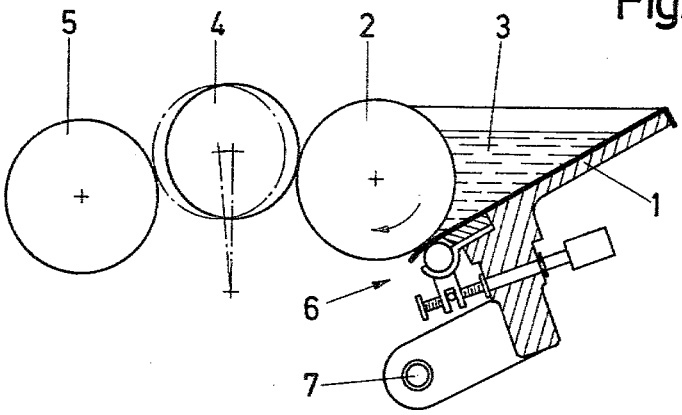
FIG. 1 is a sectional view of an ink duct according to the invention with ink rollers.

Referring now to the drawing and first, particularly, to FIG. 1 thereof, there is shown, as is conventional in offset or relief printing machines, a doctor roller 2 associated with an ink duct 1 and defining therebetween, a wedge-shaped chamber filled with ink 3. The ink 3 is fed in a thin ink film by the doctor roller 2 over an oscillating conventional siphon roller 4 to an inking roller 5, from which it is transferred to a non-illustrated inking unit. In this process, the ink film is adaptable to respective requirements by the use of an ink metering device 6. To permit the ink duct 1 to be cleaned, it is pivotable about a pivot joint 7. The length of the ink duct 1 and of the rollers is selected in conformity with the paper format to be printed. In a conventional manner, the ink duct 1 and the rollers are mounted at both sides or ends thereof, respectively, in non-illustrated side walls of the printing machine.

The ink metering device 6 is formed of zone-wide adjusting elements 8 which are disposed closely adjacent one another and extend over the width of the ink duct 1. In the exemplary embodiment illustrated in FIG. 2, the adjusting elements 8 are of cylindrical construction and are rotatable in peripheral or circumferential direction. Associated with each adjusting element 8 is a spring 9 which embraces the latter and presses it toward or against the doctor roller 2. The springs 9 are affixed to the ink duct 1 by means of a cover strip 10 which, in the detached condition of the ink duct 1, serves as stop means for the springs 9. The adjusting elements 8 are covered by an elastic foil 11 which is, in turn, fixed in an upper region 12 thereof to the ink duct 1. The force of the springs 9 is thus transmitted through the adjusting elements 8 and the foil 11 to the doctor roller 2.

Figure 3:
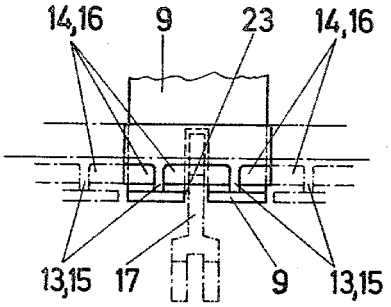
FIG. 3 is a fragmentary plan view of FIG. 2 as seen in direction of the arrow 3.

Viewed in axial direction of the doctor roller 2, bracing regions 13 and metering regions 14 are disposed adjacent one another on the adjusting elements 8 (FIG. 3). The bracing regions 13 are always in contact with the doctor roller 2, through the intermediary of the foil 11, even when the adjusting elements 8 are adjustingly shifted. The metering regions 14 are adjustable to a variable spacing relative to the doctor roller 2, so that the respective spacing thereof from the doctor roller 2 determines the ink gap in that zone.

Figure 2:
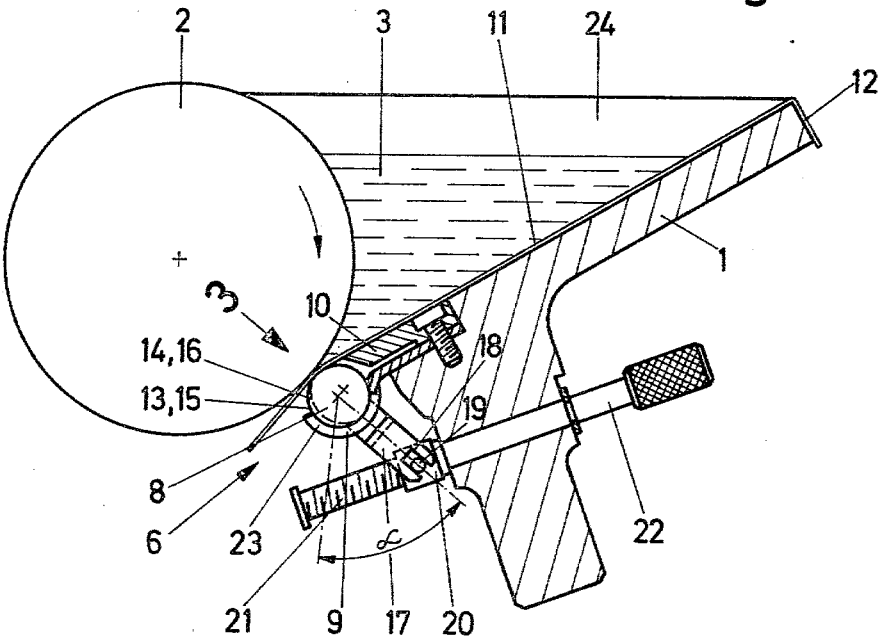
FIG. 2 is an enlarged sectional view of the ink duct of FIG. 1.

In the exemplary embodiment illustrated in FIGS. 2 and 3, the adjusting elements 8 are cylindrical construction and exhibit one or more narrow bracing surfaces as bracing regions 13. Metering areas 16 located adjacent bracing surfaces 15 are constructed as eccentric tapped grooves. By rotating the adjusting elements 8, the respective spacing, in the region of the metering surfaces 16, of the latter relative to the doctor roller 2 is adjustable, and the ink gap in that zone can thus be determined. The farther the eccentric tapped groove of the metering surface 16 recedes relative to the bracing surface 15, the greater the ink gap becomes. In this regard, the elastic foil 11 is raised from the surface of the doctor roller 2 by the static pressure of the ink 3 and is pressed against the metering surface 16, depending upon the position of the latter. The ink gap formed thereby in this region determines the thickness of the ink film and, accordingly, the quantity of ink to be transferred into the inking unit.

To effect rotation of the adjusting elements 8, a bifurcated arm 17 is attached thereto and is coupled, by means of a slot 18 formed therein, to a bolt 19 of an adjusting nut 20. The adjusting nut 20 is in turn secured on a threaded part 21 of a set screw 22 which is rotatably mounted in the ink duct 1. By rotating the set screw 22, the adjusting nut 20 can be displaced and the arm 17 thus pivoted through an angle $\alpha$. In this regard, the arm 17 pivots in a slot 23 formed in the spring 9. The pivoting range of the arm 17 thus determines the range of adjustment of the adjusting element 8.

The disposition of the bracing surfaces 15 of the metering surfaces 16 on the adjusting elements 8 may be effected in the manner illustrated in FIG. 3 i.e. with the bracing surfaces 15 being inwardly offset with respect to the length of an adjusting element 8. Other arrangements are also possible, such as the narrow bracing surfaces 15 being disposed on both sides at the end of an adjusting element 8 and being thus in contact with the respective bracing surface 15 of the adjacent element 8. The width of a bracing surface 15 is adequately dimensioned at approximately 1 to 3 mm.

The foil 11 extends over the length of the ink duct 1 and normally reaches on both sides thereof to below closure members 24 for the wedge-shaped chamber of the ink 3.

Figure 4:
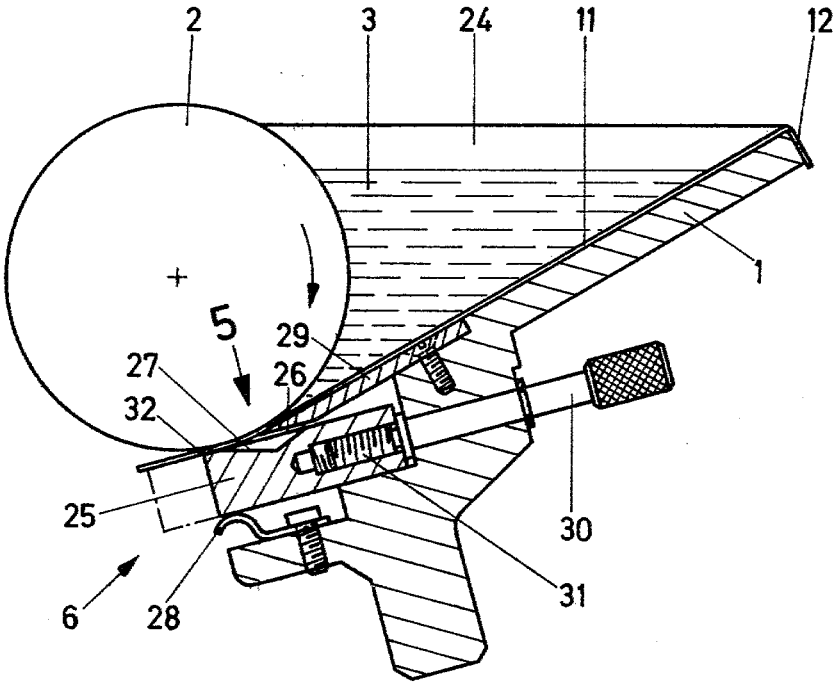
FIG. 4 is a view like that of FIG. 2 of another embodiment of the ink duct having flat or planar adjusting elements.
Figure 5:
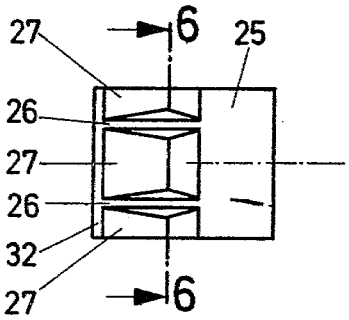
FIG. 5 is a fragmentary plan view of FIG. 4 as seen in direction of the arrow 5 and showing a flat or planar adjusting element.
Figure 6:
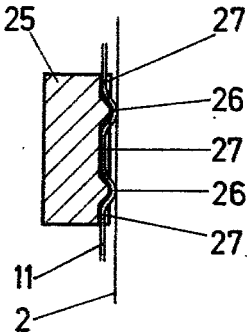
FIG. 6 is a cross-sectional view of FIG. 5 taken along the line 6—6 in direction of the arrows.

The embodiment according to FIG. 4 differs essentially from that of FIG. 2 only in the construction of the ink metering device 6. In FIG. 4, the adjusting elements 25 are constructed as slidable flat members which have one or more bracing surfaces 26. Directly adjacent the bracing surfaces 26, metering surfaces 27 are constructed as recesses extending wedge-shaped inwardly (FIGS. 5 and 6).

These adjusting elements 25 are also disposed closely adjacent one another over the length of the ink duct 1. They are pressed with the bracing surfaces 26 thereof against the foil 11, and the latter, in turn, against the doctor roller 2, by the force of the spring 28. In the region of the adjusting elements 25, the foil 11 is supported by a cover strip 29 which serves simultaneously as a stop for the adjusting elements 25 when the ink duct 1 is pivoted away. A set screw 30, upon rotation of which, a thread 31 formed thereon shifts a respective adjusting element 25, serves for tangential shifting of the adjusting elements 25. In retracted position of the adjusting element 25 illustrated by solid lines in FIG. 4, a continuous front edge 32 thereof is in contact with the foil 11 and thereby with the doctor roller 2, so that, in this regard, no ink can be transferred into the inking unit. If the adjusting element 25 is now slid to the left-hand side, as viewed in FIG. 4, it is then in contact with the foil 11 solely by the bracing surface 26 thereof, and in the region of the wedge-shaped metering surfaces, the foil 11 is lifted away from the doctor roller 2 and comes into contact with the metering surfaces, so that an adjustable ink film can be transferred. Maximum contact in this respect, is obtained in the position of the adjustment element 25 shown in phantom in FIG. 4. Also with this construction of the adjusting element 25 the bracing surface 26 may be disposed as desired.

Figure 7:
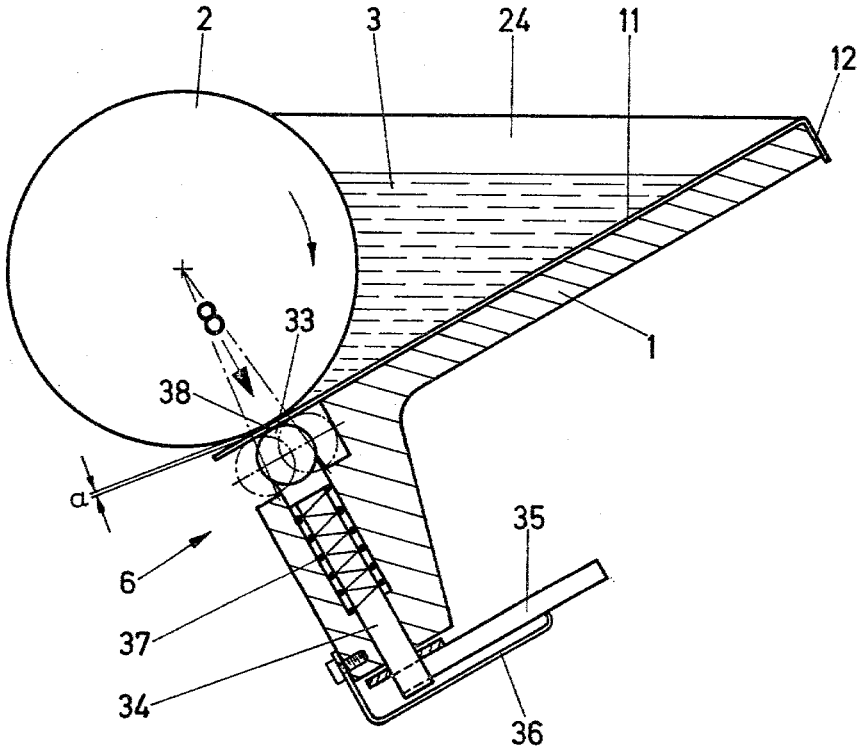
FIG. 7 is a view like those of FIGS. 1 and 4 of a third embodiment of the ink duct having tangentially pivotable adjusting elements.

The embodiment according to FIG. 7 differs from the hereinaforedescribed embodiments of the invention in the construction of the ink metering device 6. In FIG. 7 the adjusting elements 33 are of cylindrical construction and have no recesses for metering surfaces. The adjusting elements 33 are fastened to a pin 34 in the elongation or extension between the center of the doctor roller 2 and that of the adjusting elements 33, the pin 34 being mounted rotatably in the ink duct 1. A handle 35 serves for rotating the pin 34 and is pivotable through an angle $\alpha$ and arrested or stopped by a spring plate 36 which is fixed to the ink duct 1.

Figure 8:
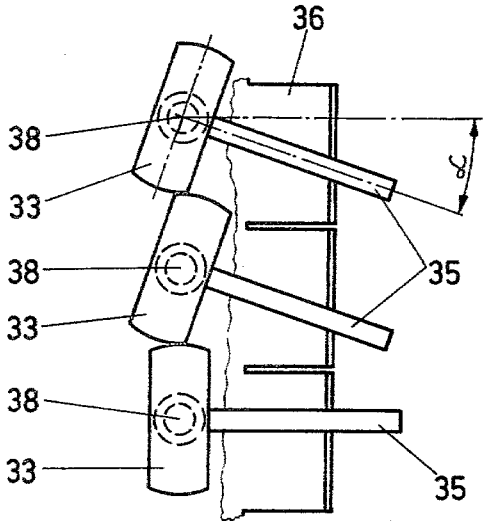
FIG. 8 is a fragmentary plan view of FIG. 7 as seen in direction of the arrow 8 and showing the adjusting elements.

The adjusting element 33 is biased or pressed through the intermediary of the foil 11 against the doctor roller 2 by a compression spring 37. When the adjusting element 33 is in the initial position thereof, in which the longitudinal axis thereof extends parallel to the longitudinal axis of the doctor roller 2, as is illustrated for the lower adjusting element 33 in FIG. 8, it is in contact through the foil 11 with the doctor roller 2 along the entire length thereof, whereby the ink feed in this zone is cut off. When the adjusting elements 33 are pivoted tangentially to the doctor roller 2 through the angle $\alpha$, the ends of the adjusting elements 33 are shifted with respect to the doctor roller 2 and the contact surfaces thereof move apart. This creates the gap a, by the variable width of which, likewise, the thickness of the ink film to be transferred into the inking unit can be adjusted. In this regard, the adjusting element 33 is always in contact, through the foil 11, with the doctor roller 2 at the tangent point 38 thereof. The pivoting of the adjusting elements 33 thus always occurs about this tangent point 38.

Figure 9:
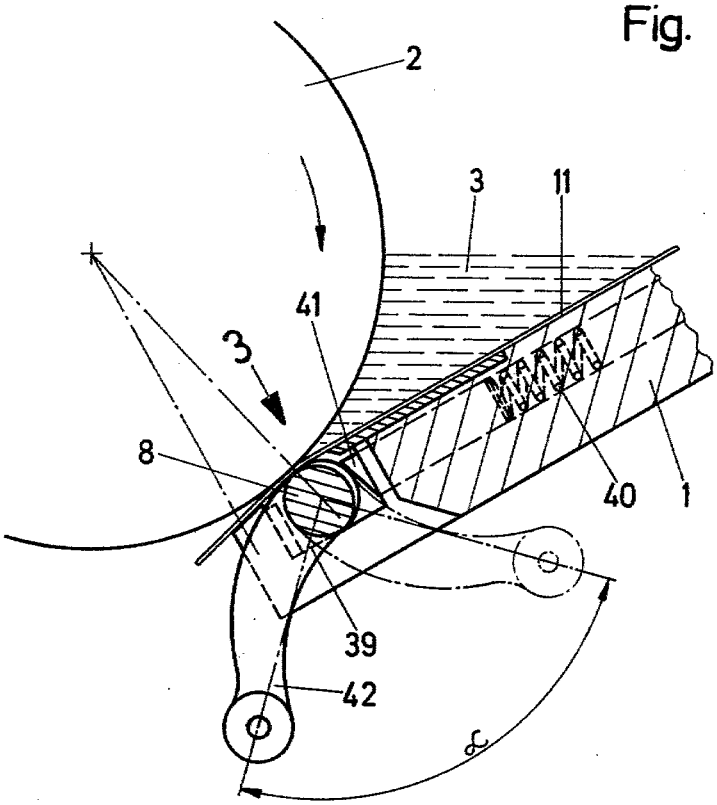
FIG. 9 is a partial sectional view, enlarged over the views of FIGS. 1, 4 and 7, of a fourth embodiment of the ink duct showing the adjusting elements thereof.

FIG. 9 shows a mounting of the adjusting element 8 in the ink duct 1 on a surface 39 oriented in wedge-shaped manner with respect to the doctor roller 2. A compression spring 30, in FIG. 9, acts through a pressure piece 41 upon the adjusting element 8 so that it is biased or pressed through the foil 11 against the doctor roller 2 by the surface 39 extending wedge-shaped to the doctor roller 2. Here also the rotation of the adjusting element 8 is effected through the intermediary of arms 42 through the angle $\alpha$.

Figure 10:
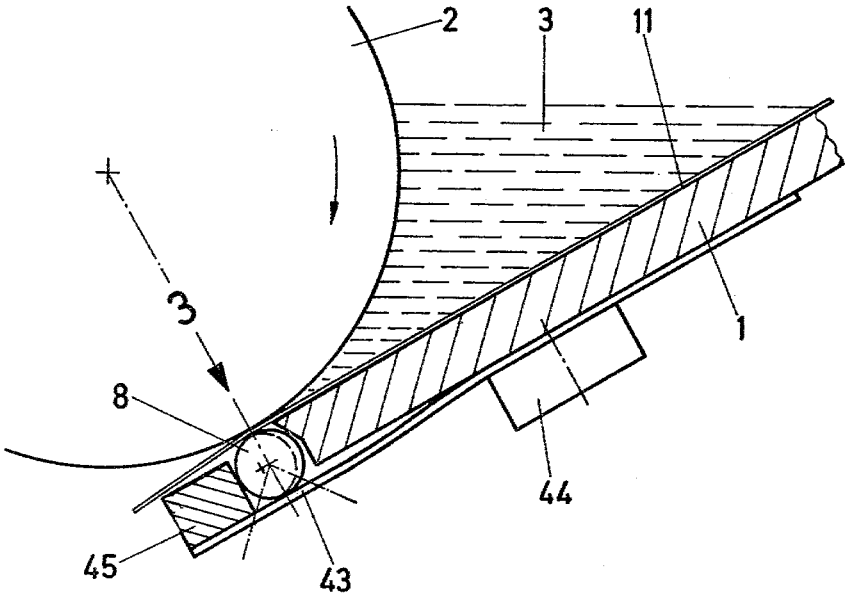
FIG. 10 is a view similar to that of FIG. 9 showing a fifth embodiment of the ink duct having a different bearing system for the adjusting elements than that of the embodiment of FIG. 9.

In FIG. 10, the adjusting element 8 is biased through the foil 11 against the doctor roller 2 by a leaf spring 43. The leaf spring 43 is fixed to the ink duct 1 by means of a bar 44. In a forward region thereof, the leaf spring 43 carries a stop 45 for the adjusting element 8. The operation and adjusting displacements of the adjusting element 8 occurs in the hereinaforedescribed manner.

Figure 11:
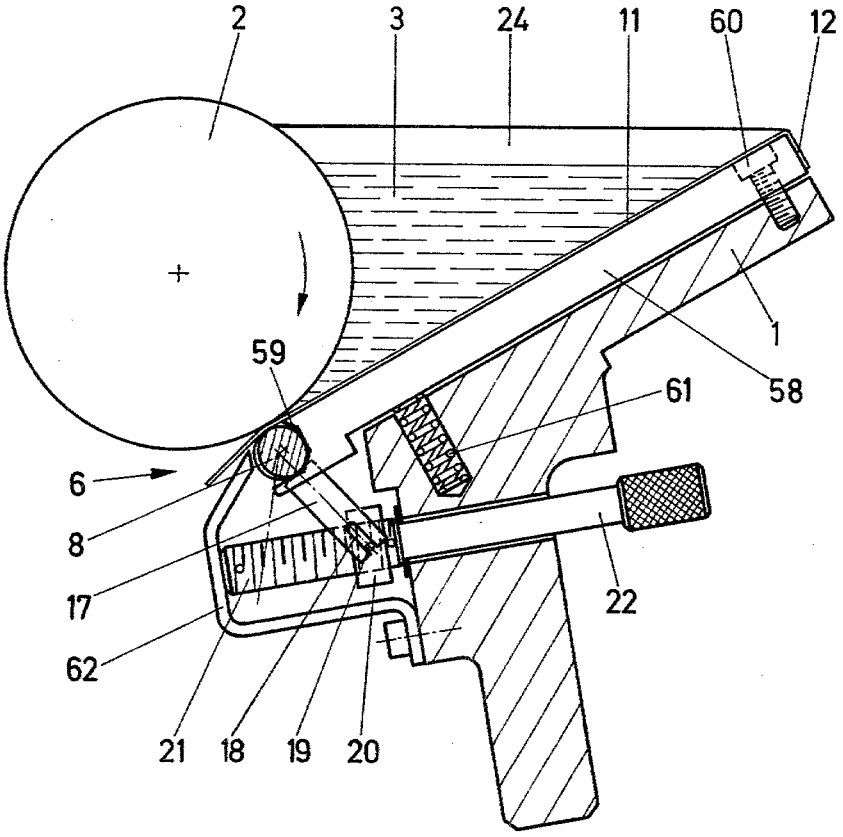
FIG. 11 is a view similar to those of FIGS. 1, 4, 7 and 9 of a sixth embodiment of the ink duct.

The exemplary embodiment illustrated in FIG. 11 employs an ink metering device 6 as shown in FIG. 2. Only the adjusting elements 8 are shown mounted in FIG. 11 in zonewise subdivided pressure bars or strips 58, which are masked by the foil 11 and have formed, in a forward region thereof, a recess 59 for the adjusting element 8. The pressure bars 58 are attached loosely to the ink duct 1 by screws or bolts 60 so that compression springs 61, through the pressure bars 58, bias the adjusting elements 8 against the foil 11 and consequently against the doctor roller 2. A guard or cover 62 is constructed so that it prevents the adjusting elements 8 from falling out when the ink duct is pivoted away. Here again the principle of operation of the ink metering device 6 corresponds to the hereinaforedescribed exemplary embodiments.

In the various exemplary embodiments of the invention which have been described hereinbefore, it is immaterial whether the foil 11 is disposed at a slight angle with respect to the doctor roller 2, as shown in FIG. 2 slightly or partly surrounds the doctor roller 2, as in FIG. 4, or extends precisely tangentially to the doctor roller 2, as in FIG. 7. The deformation of the foil 11 is not affected by the elasticity thereof.

Figure 12:
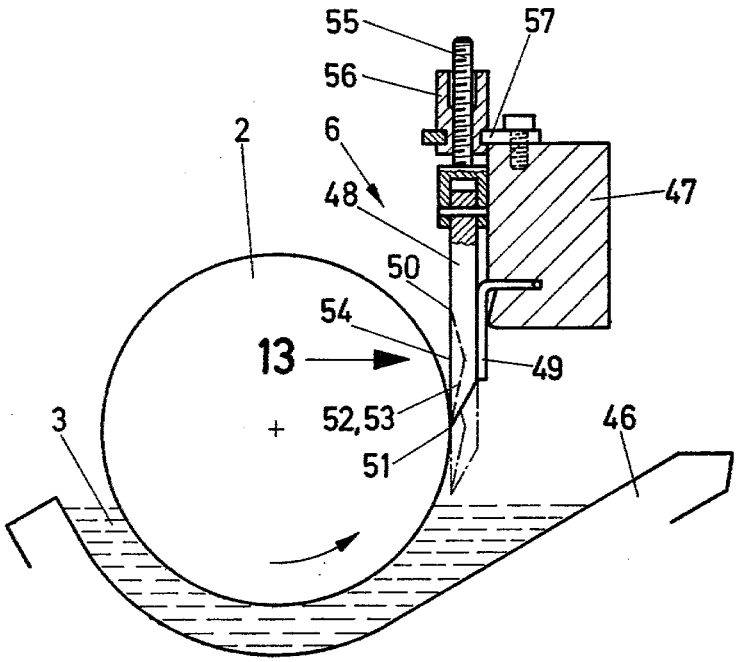
FIG. 12 is a view similar to those of FIGS. 1, 4, 7, 9 and 11 of a seventh embodiment of the tangentially slidable adjusting elements.
Figure 13:
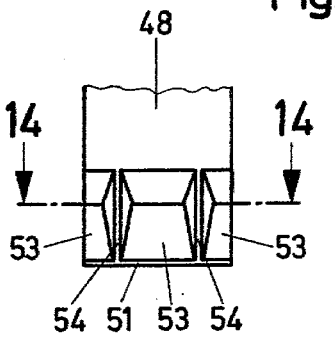
FIG. 13 is a fragmentary plan view of FIG. 12 as seen in direction of the arrow 13 and showing an adjusting element.
Figure 14:
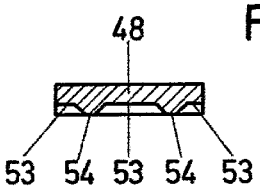
FIG. 14 is a cross-sectional view of FIG. 13 taken along the line 14—14 in direction of the arrows.

FIG. 12 shows an exemplary embodiment of the invention wherein the ink duct 46 is disposed beneath the doctor roller 2 and wherein the ink metering device 6 is mounted on a traverse or crosspiece 47 of the ink duct 46. Also with this embodiment of FIG. 12, a plurality of adjusting elements 48 are disposed along the length of the ink duct 2, and are respectively biased towards the doctor roller 2 by a leaf spring 49 attached to the crosspiece 47. In contradistinction to the embodiments described hereinbefore, in this regard, the adjusting elements 48 of the embodiment of FIG. 12 are not covered by a foil, but are in direct tangential contact at one side 50 thereof with the doctor roller 2. In a forward region of the adjusting elements 48, the latter have a wiping edge 51, immediately behind which an obliquely inwardly extending recess 52 begins, which is constructed as a metering surface 53 (FIGS. 13 and 14). The metering surfaces 53 occupy the width of the respective adjusting element 48 except for narrow bracing surfaces 54. The bracing surfaces 54 are constructed as narrow bridges and form a plane with the side 50 and with the wiping edge 51.

The adjusting elements 48 are slidable or shiftable tangentially to the doctor roller 2, the sliding or shifting being effected through a threaded rod 55 and an adjusting nut 56 which is fixed to the cross-member 47 by a rotary bearing. FIG. 12 shows the retracted position of the adjusting element 48, in which the wiping edge 51 is in contact with the doctor roller 2 due to the force applied by the leaf spring 49, so that no ink is transferred into the inking unit in that zone. As the adjusting elements 48 are slid downwardly into the position thereof shown in phantom in FIG. 12, the thickness of the ink film increases continuously in conformity with the obliquely inwardly extending metering surfaces 53. The phantom position of the adjusting elements 48, as shown in FIG. 12, indicates a maximum. Here, also the bracing surfaces 54 may be distributed as desired across the width of the adjusting elements 48.

In the interest of clarity, the metering surfaces are shown deeper in the drawings than is necessary in practice. The depth of the metering surfaces corresponds in practice approximately to the maximum ink film thickness required.

There are claimed:

1. Ink duct for printing machines provided with a doctor roller, the ink duct having an ink metering device adjustable with respect to the doctor roller for varying an ink gap therebetween and thereby thickness of ink receivable in said variable ink gap, the ink metering device comprising adjusting means for varyingly adjusting the gap zonewise between the ink metering device and the doctor roller, said adjusting means being formed with respective bracing regions at which said adjusting means are braced against the doctor roller and respective metering regions at which a variable metering gap is defined thereby with the doctor roller, said bracing regions and said metering regions being located adjacent one another in a plurality of respective zones disposed in axial direction of the doctor roller, and respective means for resiliently biasing said adjusting means continuously into a contact relationship with the doctor roller at said bracing regions and for adjustably varying a spacing of said adjusting means from said doctor roller at said metering regions so that the respective spacing of the respective metering regions from the doctor roller determines the ink gap in each of the respective zones, said adjusting means comprising a plurality of adjusting elements of substantially cylindrical construction rotatable in peripheral direction thereof, the respective bracing regions being narrow with respect to the width of the respective metering regions, and the respective metering regions being formed by eccentric tapped grooves located adjacent the respective bracing regions, said ink metering device including zonewise subdivided pressure strips, said resilient biasing means supportingly biasing said presusre strips toward the doctor roller, said pressure strips being formed with a recess in a forward region thereof wherein said cylindrical adjusting elements are received, said adjusting means further including an elastic foil fixed to said ink metering device and covering said pressure strips and said adjusting elements, the respective bracing regions being biased by said resilient biasing means into indirect contact with the doctor roller through the intermediary of said elastic foil.

2. Ink duct for printing machines provided with a doctor roller, the ink duct having an ink metering device adjustable with respect to the doctor roller for varying an ink gap therebetween and thereby thickness of ink receivable in said variable ink gap, the ink metering device comprising adjusting means for varyingly adjusting the gap zonewise between the ink metering device and the doctor roller, said adjusting means being formed with respective bracing regions at which said adjusting means are braced against the doctor roller and respective metering regions at which a variable metering gap is defined thereby with the doctor roller, said bracing regions and said metering regions being located adjacent one another in a plurality of respective zones disposed in axial direction of the doctor roller, and respective means for resiliently biasing said adjusting means continuously into a contact relationship with the doctor roller at said bracing regions and for adjustably varying a spacing of said adjusting means from said doctor roller at said metering regions so that the respective spacing of the respective metering regions from the doctor roller determines the ink gap in each of the respective zones.

3. Ink duct according to claim 2 wherein said adjusting means comprise a plurality of adjusting elements and an elastic foil fixed to said ink metering device and covering said adjusting elements, the respective bracing regions being in indirect contact with the doctor roller through the intermediary of said elastic foil.

4. Ink duct according to claim 2 wherein the respective bracing regions are disposed in direct contact with the doctor roller.

5. Ink duct according to claim 3 wherein said adjusting elements are of cylindrical construction and rotatable in peripheral direction thereof, and wherein the respective bracing regions are narrow with respect to the width of the respective metering regions the latter being formed by eccentric tapped grooves located adjacent the respective bracing regions.

6. Ink duct according to claim 3 wherein said adjusting elements are constructed of slidable flat members formed with at least one of said bracing regions, and at least one of said metering regions being formed of a wedge-shaped recess located adjacent said one bracing region.

7. Ink duct according to claim 3 wherein said adjusting elements are of cylindrical construction and have a longitudinal axis with which they are pivotable with respect to the longitudinal axis of the doctor roller about a point of tangency thereof with the doctor roller through the intermediary of said elastic foil.

8. Ink duct according to claim 2 wherein said ink metering device has a fixed support, said resilient biasing means being braced on said fixed support and resiliently biasing the respective bracing region of said adjusting means into continuous direct contact with the doctor roller, said adjusting means being constructed as slidable flat members disposed in tangential contact with the doctor roller at a bracking surface of the bracing region at one side of said flat members, said slidable flat members being formed with a wiping edge at a forward end thereof and an oblique inwardly extending recess directly behind said wiping edge and forming a metering surface of the metering region extending over the width of the respective support element except for at least one bridge which is relatively narrow compared to the width of said metering surface, said bridge being formed with said bracing surface.

9. Ink duct according to claim 2 wherein said resiliently biasing means comprise a plurality of members for resiliently biasing said adjusting means at the respective bracing regions thereof continuously into said contact relationship thereof with the doctor roller.

10. Ink duct according to claim 2 wherein said metering regions of said adjusting means are, respectively, wedge-shaped.

* * * * *